United States Patent [19]

Monteith

[11] Patent Number: 4,816,144

[45] Date of Patent: Mar. 28, 1989

[54] SIEVING APPARATUS

[75] Inventor: John Monteith, Whitton, England

[73] Assignee: Russell Finex Limited of Russell House, London, England

[21] Appl. No.: 11,860

[22] Filed: Feb. 4, 1987

[30] Foreign Application Priority Data

Feb. 13, 1986 [GB] United Kingdom ..... 8603524
May 27, 1986 [GB] United Kingdom ..... 8612745

[51] Int. Cl.[4] ..... B07B 1/42

[52] U.S. Cl. ..... 209/364; 209/365.1; 366/127

[58] Field of Search ..... 209/357, 360, 364, 365 R, 209/368, 255, 365.1; 310/322, 324; 366/127

[56] References Cited

U.S. PATENT DOCUMENTS

| | | | |
|---|---|---|---|
| 2,695,102 | 11/1954 | Hamacher | 209/364 |
| 2,880,871 | 4/1959 | Bruninghaus | 209/368 |
| 3,261,469 | 7/1966 | Wehner | 209/365.1 |
| 3,490,584 | 1/1970 | Balamuth | 209/357 |
| 4,261,817 | 4/1981 | Edwards et al. | 209/357 |
| 4,307,964 | 12/1981 | Dudgeon et al. | 366/127 |

FOREIGN PATENT DOCUMENTS

| | | | |
|---|---|---|---|
| 0203566 | 12/1986 | European Pat. Off. | 209/364 |
| 0763004 | 9/1980 | U.S.S.R. | 209/364 |
| 1094218 | 12/1964 | United Kingdom . | |
| 1406269 | 11/1972 | United Kingdom . | |
| 1462866 | 1/1977 | United Kingdom | 209/364 |
| 2008809 | 11/1978 | United Kingdom . | |

*Primary Examiner*—Robert B. Reeves
*Assistant Examiner*—Donald T. Hajec
*Attorney, Agent, or Firm*—Wenderoth, Lind & Ponack

[57] ABSTRACT

Sieving apparatus has a piezo-electric transducer (1) directly bonded to a grating (100), the supply to the transducer (1) being controlled by sensing resonance of the grating (100) and any deviation therefrom and controlling the supply to maintain resonance.

4 Claims, 3 Drawing Sheets

SIEVING APPARATUS

BACKGROUND OF THE INVENTION

1. Field of the Invention

This invention relates to sieving apparatus.

2. Description of the Prior Art

In GB-A-1462866 there is described such apparatus, for sieving dry particulate material, comprising a base, a frame mounted on the base for vibratory movement with respect thereto, a grating attached to the frame, means for vibrating the frame relative to the base, and ultrasonic means coupled to the grating to effect ultrasonic vibration thereof relative to the frame.

In this known apparatus the ultrasonic means comprises an electro-mechanical transducer, and in particular a magnetostrictive transducer, the body of which is rigidly mounted with respect to the frame and which is coupled to the grating by means of a metal probe.

With such apparatus the low frequency vibration of the grating effected by the oscillation of the frame serves for bulk movement of material on the grating so that all layers of material are presented to the grating, while the high frequency vibration of the grating effected by the ultrasonic means serves to prevent blinding of the apertures of the grating otherwise caused by material adhering to the grating or by particles of the material locking together to bridge the apertures.

A disadvantage of such known apparatus is that the magnetostrictive transducer becomes hot and requires a supply of large volumes of cooling air to maintain a satisfactory temperature during operation. Further, the transducer is relatively large and heavy, and adds significantly to the mass to be oscillated.

SUMMARY OF THE INVENTION

According to this invention there is provided sieving apparatus comprising a base, a frame mounted on the base, a grating attached to the frame, and ultrasonic means coupled to the grating to effect ultrasonic vibration thereof relative to the frame, in which the ultrasonic means comprises a piezo-electric transducer directly bonded to the grating.

The apparatus of this invention has the advantage that the transducer is relatively small and light, and does not require significant cooling during operation. Further, the transducer is tunable, and can be provided with means for frequency control, and preferably automatic control, whereby the optimum amplitude range of the ultrasonic vibrations of the grating for most effective operation of the apparatus can be achieved and maintained.

Preferably the transducer in energized by a supply circuit including means to sense resonance of the grating and any deviation therefrom, and feedback means operative in response to the output of said sensing means to control the supply to the transducer to maintain resonance of the grating.

A transducer as used in the apparatus of the present invention has minimum impedance at resonance and this impedance can be sensed and used to control the output of a free running oscillator by which the transducer is powered.

The impedance can be sensed by sensing the voltage across a resistor connected across the supply to the transducer, the sensed voltage being used as a feedback signal for control of the oscillator.

Although in the known apparatus described above the frame is vibrated relative to the base, this is not essential for apparatus according to this invention. It is otherwise possible for the material being sieved to be conveyed to and from the grating by vacuum or pressure differential means, the vibration of the grating reltative to the frame imparted by the transducer being sufficient to effect sieving.

BRIEF DESCRIPTION OF THE DRAWINGS

This invention will now be described by way of example with reference to the drawings in which.

and

Figure 3:
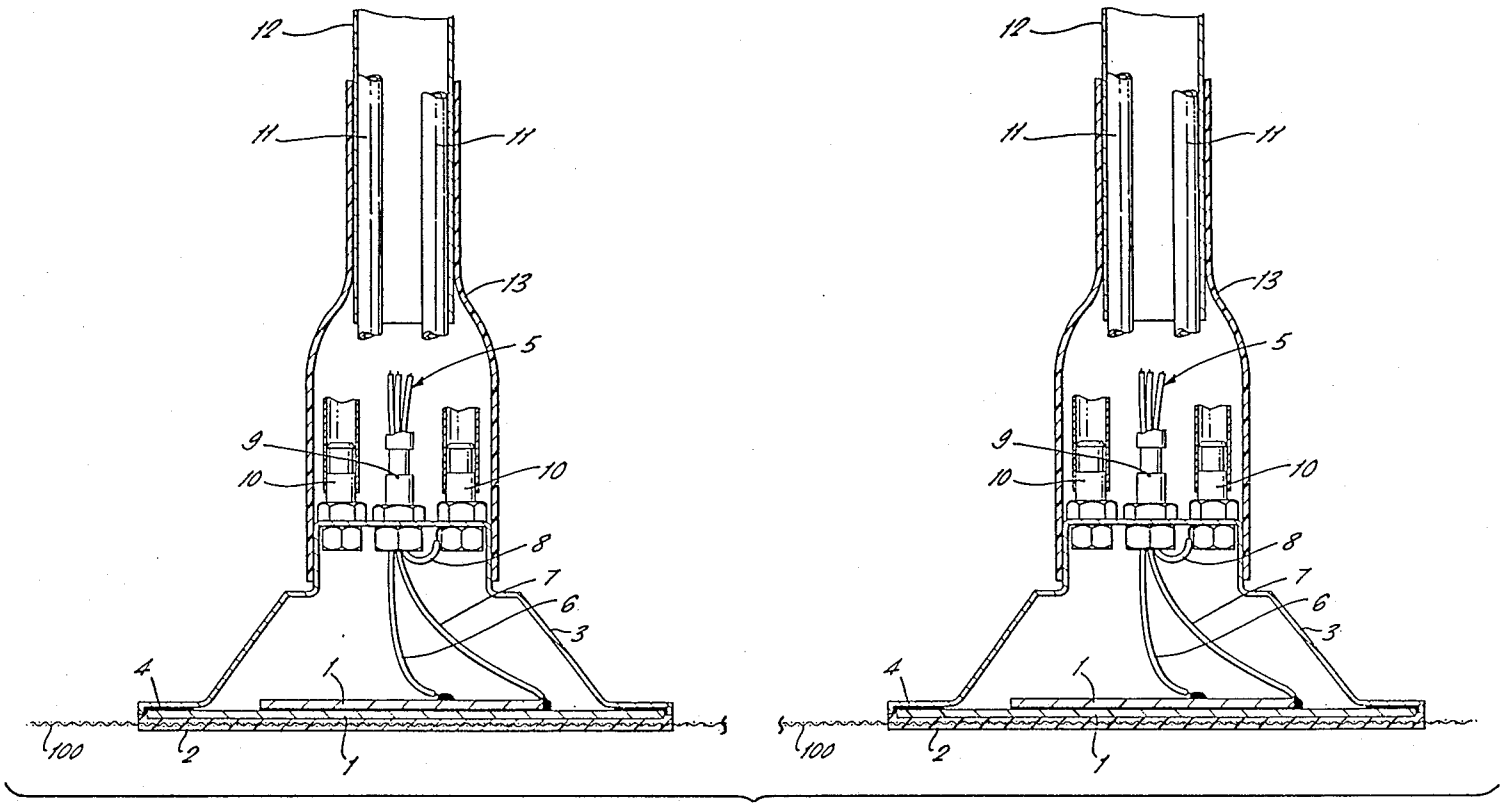

FIG. 3 shows a grating having a plurality of transducers according to the invention.

DETAILED DESCRIPTION OF THE PREFERRED EMBODIMENTS

Figure 1:
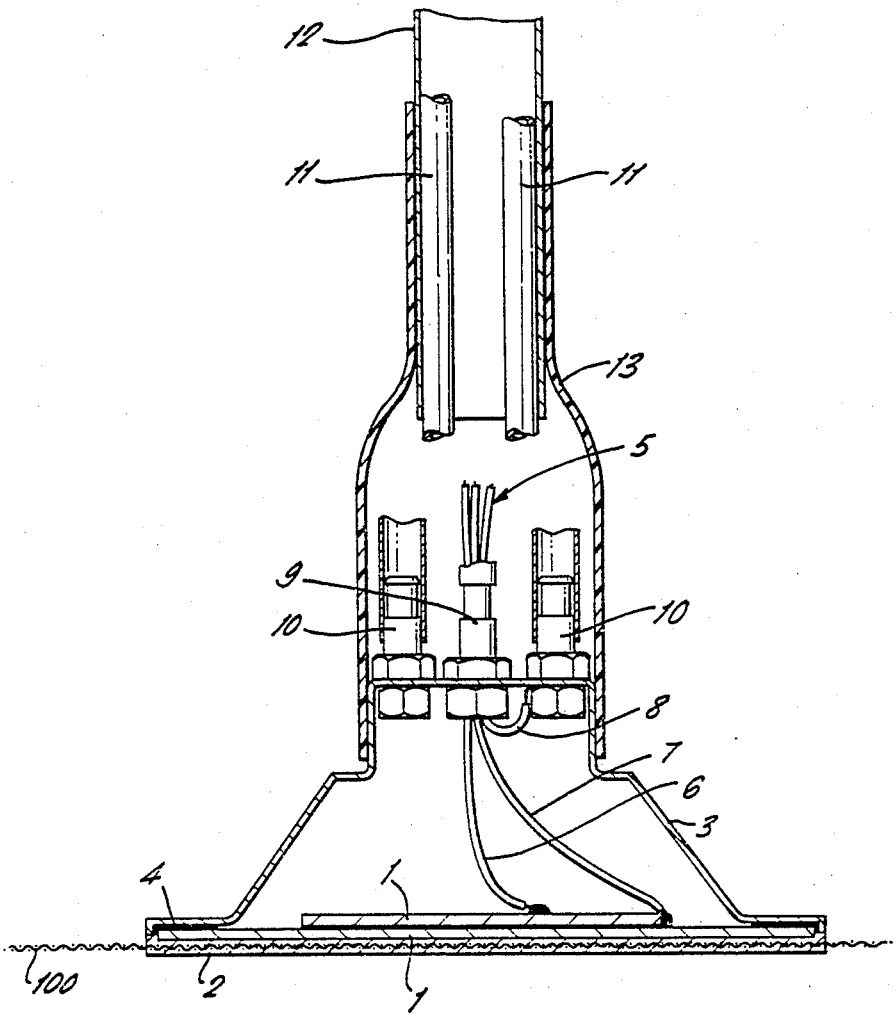
FIG. 1 is a vertical sectional view through an ultrasonic transducer arrangement for use in apparatus according to the invention.

Suitable vibratory sieving apparatus to be modified to embody the present invention is disclosed in GB-A-1462866, and will not therefore be described in detail herein. FIG. 1 of the drawings shows an ultrasonic vibration means which replaces the magnetostrictive transducer of the known apparatus shown in GB-A-1462866.

Referring to FIG. 1, a piezo-electric transducer 1 is bonded by means of adhesive 2 to the grating 100 of the known sieving apparatus. The transducer 1 is covered by a spun metal shroud 3 secured thereto at its periphery by adhesive 4.

The shroud 3 carries a termination or connector 9 for an electric supply cable 5 having two wires 6 and 7 connected to the transducer 1 and an earth or ground wire 8 connected to the shroud 3, and also two terminations or connectors 10 for cooling air supply pipes 11. The cable 5 and pipes 11 are encased in a heat-shrunk cover 12 which is secured to the shroud 3 by a length of heat-shrunk tubing 13.

In use of the apparatus, energization signals are supplied to the transducer 1 over the cable 5 thereby to produce the required vibration of the grating 100, while cooling air is supplied through the pipes 11 to cool the transducer 1 particularly to prevent overheating of material (not shown) being sieved by the apparatus.

Figure 2:
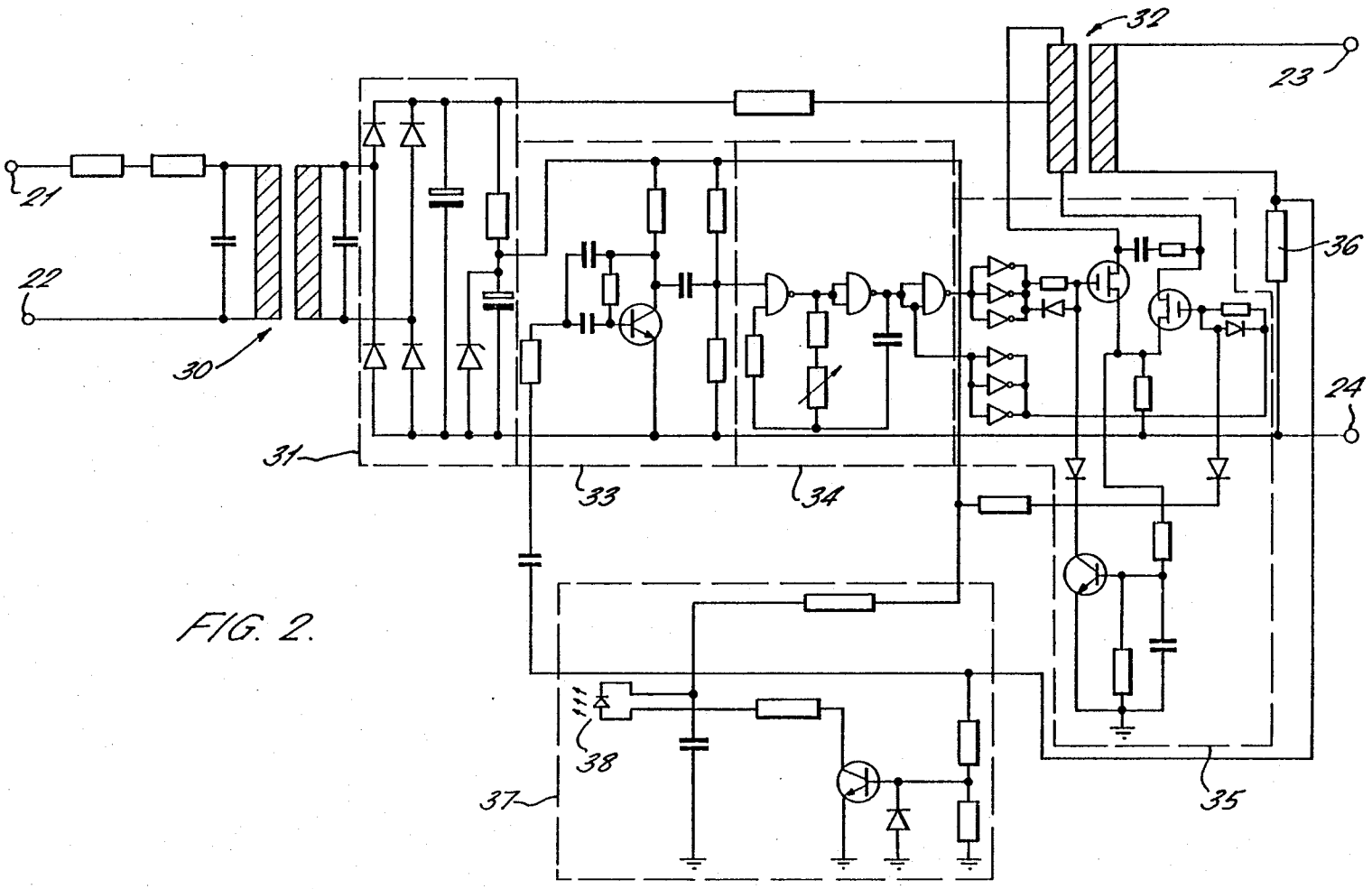
FIG. 2 is a circuit diagram of a supply circuit for use in the apparatus of FIG. 1.

The signals supplied to the transducer 1 are controlled in dependence upon the operation of the apparatus, in order to obtain a required vibration of the grating 100 in order to achieve the required sieving operation, and FIG. 2 shows a circuit for such purpose.

The supply circuit is fed from a conventional 240V supply at input terminals 21 and 22, and the transducer 1 (not shown) of the apparatus is connected to output terminals 23 and 24. The input voltage is applied across the primary winding of an input transformer 30, the output from the secondary winding of which is applied to a rectification and smoothing network 31.

The output of the network 31 is applied to a center tap on the primary winding of an output transformer 32, and the network 31 also provides an input to an oscillator control network 33 which functions to control a free running oscillator 34.

The output of the oscillator 34 is applied by way of a network 35 comprising a push-pull arrangement of two power MOSFETs, across the primary winding of the output transformer 32.

The secondary winding of the output transformer 32 is connected in series with a resistor 36 between the output terminals 23 and 24, there being a voltage feedback connection from the junction between the secondary winding of the output transformer 32 and the resistor 36, to the control network 33.

An indicator network 37 is connected to the feedback connection and the input to the control network 33, the network 37 including a light emitting diode 38 which serves to indicate functioning of the supply circuit.

In operation of the supply circuit, the output of the oscillator 34 is applied to the transducer 1 connected to the output terminals 23 and 24 to cause oscillation thereof and thus vibration of the grating 100 to which the transducer 1 is coupled.

For efficient working, it is desirable to maintain the transducer 1 and grating 100 at resonance, under which condition the impedance of the transducer 1 is a minimum such that the voltage across resistor 36 is at a maximum. Any deviation from resonance will cause a change in the voltage across resistor 36, and any such change is effective over the feedback connection to the control network 33 to effect control of the oscillator 34 as necessary to return the transducer and grating to resonance as required.

Although in the apparatus specifically described above there is only a single transducer coupled to a single grating, it will be appreciated that an apparatus can be provided having one or more separate gratings, as shown in FIG. 3, each with one or more transducers which can be driven as described above, bonded thereto. With two or more transducers coupled to a single grating they can be driven at mutually different frequencies such that the vibrational nodes and antinodes at the two or more frequencies are at different positions on the grating whereby the maximum area of the grating is vibrated.

While the invention has been described with reference to the foregoing embodiments, various changes and modifications may be made thereto which fall within the scope of the appended claims.

I claim:

1. Sieving apparatus comprising a grating; at least one piezo-electric transducer directly bonded to the grating to effect ultrasonic vibration of the grating; and a supply circuit by which the transducer is energized, the supply circuit including sensing means for sensing impedance of the transducer and thereby providing an output indicative of resonance of the grating and any deviation therefrom, and feedback means operative in response to the output of the sensing means for controlling the energization of the transducer to thereby maintain a required resonance of the grating.

2. Apparatus as claimed in claim 1, wherein the supply circuit includes a free running oscillator which provides an output for energizing the transducer and the output of the sensing means controls the output of the free running oscillator thereby controlling the energization of the transducer.

3. Apparatus as claimed in claim 2, wherein the supply circuit includes output terminals electrically connected to the transducer and the sensing means includes a resistor electrically connected across the output terminals whereby the sensing means operates to sense the impedance of the transducer by sensing the voltage across the resistor and the sensed voltage is used as a feedback signal for control of the oscillator.

4. Apparatus as claimed in claim 1, wherein the at least one transducer comprises a plurality of transducers bonded to the grating, the transducers being driven at mutually different frequencies such that the vibrational nodes and antinodes at the different frequencies are at different positions on the grating whereby the maximum area of the grating is vibrated.

* * * * *